US006064631A

United States Patent [19]

Lin

[11] Patent Number: 6,064,631

[45] Date of Patent: May 16, 2000

[54] FASTENING DEVICE ASSEMBLY OF MAIN BODY AND FACE PLATE OF CLOCK

[76] Inventor: Hsiu-Chun Lin, P.O. Box 23-487, Changhua City 500, Taiwan

[21] Appl. No.: 09/192,228

[22] Filed: Nov. 16, 1998

[30] Foreign Application Priority Data

Apr. 16, 1998 [TW] Taiwan ..... 87205742

[51] Int. Cl.[7] ..... G04B 37/00; G04C 23/02

[52] U.S. Cl. ..... 368/88; 368/276

[58] Field of Search ..... 368/76, 80, 88, 368/223, 276, 284, 299, 300, 309

[56] References Cited

U.S. PATENT DOCUMENTS

| | | | |
|---|---|---|---|
| 3,713,286 | 1/1973 | Trame | 368/276 |
| 4,506,993 | 3/1985 | Brown | 368/314 |
| 4,884,258 | 11/1989 | Noirjean | 368/276 |
| 4,995,023 | 2/1991 | Mulier et al. | 368/276 |
| 5,206,841 | 4/1993 | Boucheron | 368/281 |

*Primary Examiner*—Vit Miska

[57] ABSTRACT

A main body and a face plate of the clock are fastened together by a plurality of fastening strips such that both ends of each of the fastening strips are retained respectively in the retaining slot of an outer case of the main body and in the retaining portion of an inner case of the main body.

1 Claim, 4 Drawing Sheets

FASTENING DEVICE ASSEMBLY OF MAIN BODY AND FACE PLATE OF CLOCK

FIELD OF THE INVENTION

The present invention relates generally to a clock, and more particularly to a fastening device assembly of main body and face plate of the clock.

BACKGROUND OF THE INVENTION

The face plate and the main body of a conventional clock are fastened together by a plurality of screws. The screws are capable of holding effectively the face plate and the main body; nevertheless they undermine the esthetic effect of the clock. The face plate and the main body of certain conventional clocks are fastened together by tenons and mortises in place of the screws. The tenons and the mortises can not hold the face plate and the main body of the conventional clock securely together in view of the fact that the tenons are easily disengaged with the mortises. In addition, the mortises are vulnerable to damage at the time when the tenons are forced into the mortises.

SUMMARY OF THE INVENTION

The primary objective of the present invention is to provide a clock with a fastening device assembly capable of holding securely the fact plate and the main body of the clock together, without the drawbacks of the prior art means described above.

In keeping with the principle of the present invention, the foregoing objective of the present invention is attained by a main body and a cover plate. The main body is composed of an outer case and an inner case. The outer case is provided at the center thereof with a receiving hole for locating the face plate. The inner case is a round body for holding an hour hand and a minute hand of the clock and is covered by the face plate. The outer case is provided in the periphery thereof with a retaining slot, whereas the inner case is provided in the periphery thereof with a retaining portion. The inner case is fastened securely with the outer case by a plurality of fastening strips. Both ends of each of the fastening strips are retained respectively in the retaining slot of the outer case and the retaining portion of the inner case.

The foregoing objective, features, functions, and advantages of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
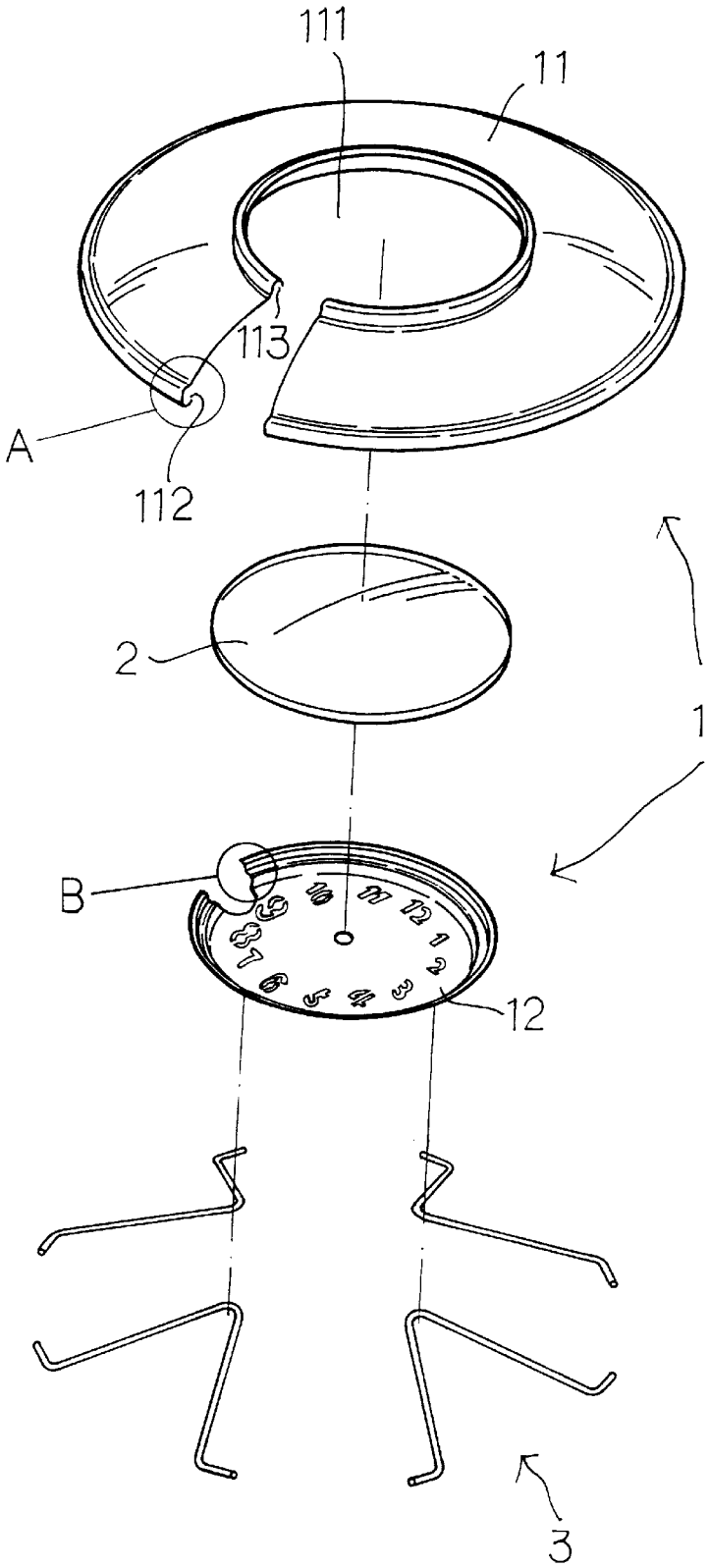
FIG. 1 shows an exploded view of the preferred embodiment of the present invention.
Figure 1A:
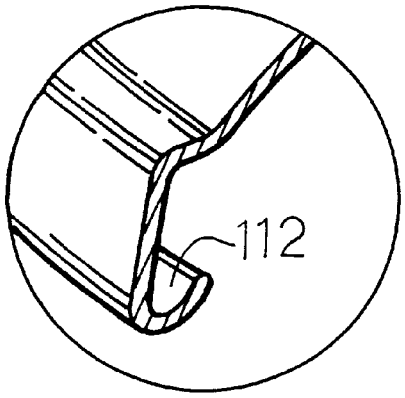
FIG. 1A shows an enlarged view of a portion indicated by a circle A as shown in FIG. 1.
Figure 1B:
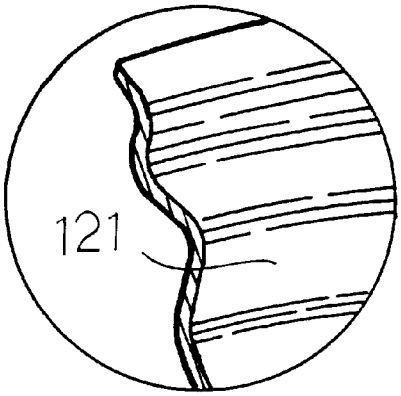
FIG. 1B shows an enlarged view of a portion indicated by a circle B as shown in FIG. 1.
Figure 2:
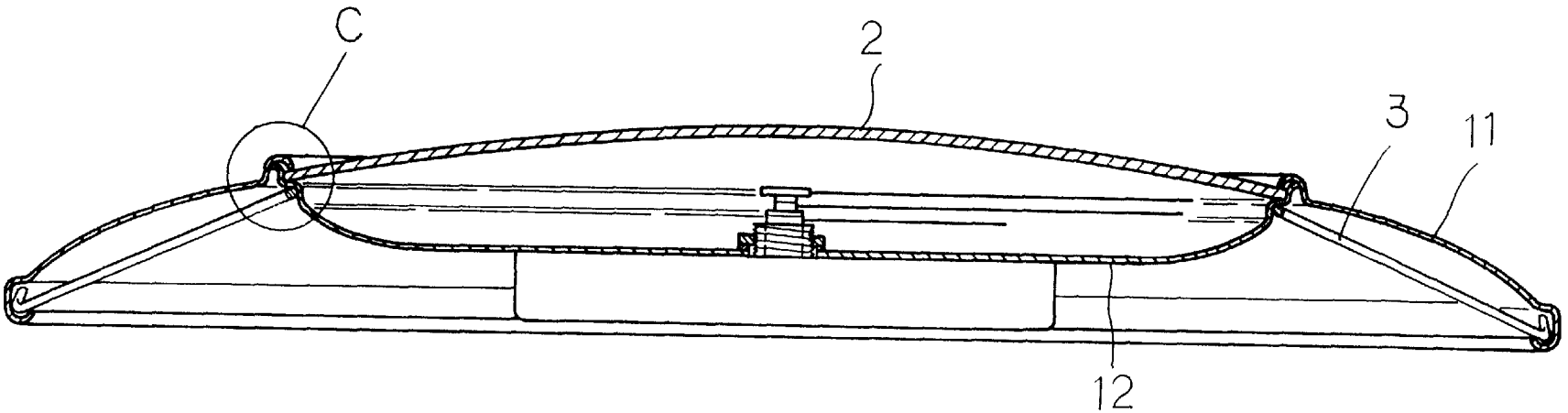
FIG. 2 shows a sectional view of the preferred embodiment of the present invention in combination.
Figure 2A:
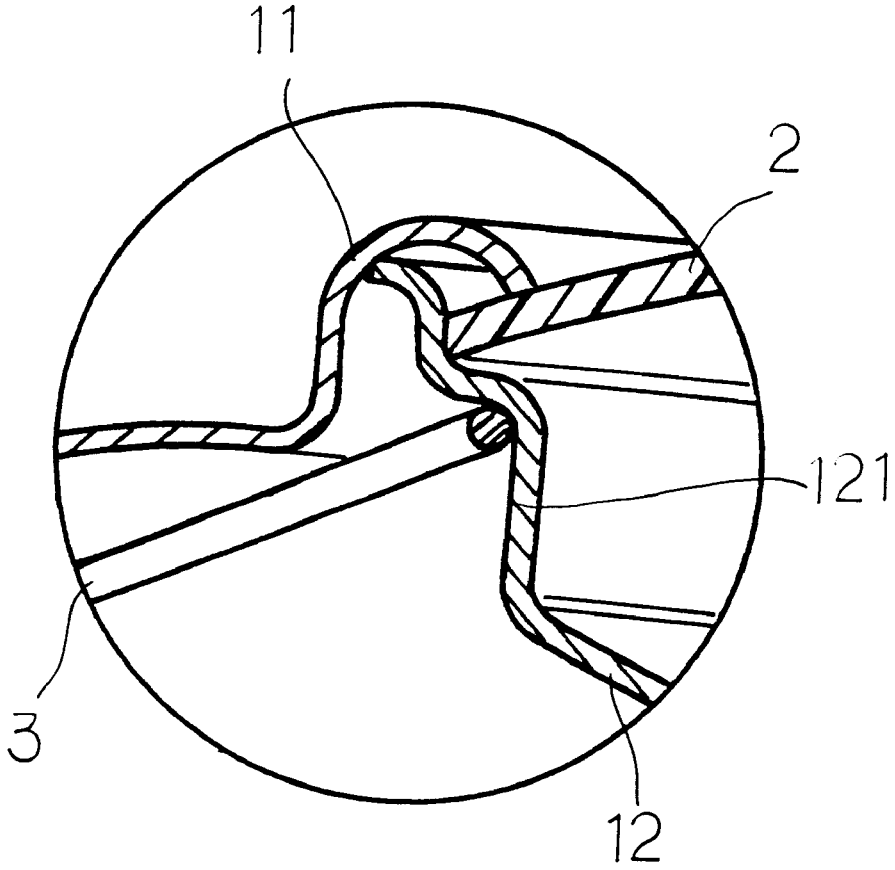
FIG. 2A shows an enlarged view of a portion indicated by a circle C as shown in FIG. 2

As shown in FIGS. 1 and 2, the preferred embodiment of the present invention is composed of a main body 1, a face plate 2, and a plurality of fastening strips 3.

The main body 1 is formed of an outer case 11 and an inner case 12. The outer case 11 is provided in the center thereof with a receiving through hole 111. The inner wall of the receiving through hole 111 is provided with a receiving slot 113. The outer case 11 is further provided in the outer periphery thereof with a retaining slot 112 extending throughout the outer periphery of the outer case 11. The inner case 12 is intended to hold an hour hand and a minute hand of a clock and is provided throughout the outer periphery thereof with a retaining portion 121.

The face plate 2 is located in the receiving through hole 111 of the outer case 11 such that the outer periphery of the face plate 2 is received in the receiving slot 113 of the outer case 111 and that the face plate 2 covers the inner case 12.

The main body 1 and the face plate 2 of the clock are fastened securely together by four fastening strips 3 such that both ends of each of the four fastening strips 3 are retained respectively by the retaining slot 112 of the outer case 11 of the main body 1 and the retaining portion 121 of the inner case 12 of the main body 1.

The embodiment of the present invention described above is to be deemed in all respects as being illustrative and not restrictive. Accordingly, the present invention may be embodied in other specific forms without deviating from the spirit thereof. The present invention is therefore to be limited only by the scope of the following appended claim.

What is claimed is:

1. A fastening device assembly of a main body and a face plate of a clock, said assembly comprising:

a main body formed of an outer case and an inner case, said outer case provided in a center thereof with a receiving through hole which is provided in an inner wall thereof with a receiving slot, said outer case further provided throughout an outer periphery thereof with a retaining slot, said inner case intended to hole an hour hand and a minute hand of the clock and provided throughout an outer periphery thereof with a retaining portion, said face plate being located in said receiving through hole of said outer case such that an outer periphery of said face plate is received in said receiving slot of the inner wall of said receiving through hole, and that said face plate covers said inner case; and a plurality of fastening strips for fastening said main body and said face plate together such that both ends of each of said fastening strips are retained respectively in said retaining slot of said outer case of said main body and in said retaining portion of said inner case of said main body.

* * * * *